US005851747A

United States Patent [19]

Takahashi

[11] Patent Number: 5,851,747

[45] **Date of Patent: *Dec. 22, 1998**

[54] SILVER HALIDE PHOTOGRAPHIC LIGHT SENSITIVE MATERIAL

[75] Inventor: Shigeaki Takahashi, Hino, Japan

[73] Assignee: Konica Corporation, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 651,803

[22] Filed: May 20, 1996

[30] Foreign Application Priority Data

May 25, 1995 [JP] Japan ..... 7-126308

[51] Int. Cl.[6] ..... G03C 1/32; G03C 1/005

[52] U.S. Cl. ..... 430/531; 430/517; 430/530; 430/569; 430/950

[58] Field of Search ..... 430/531, 950, 430/530, 517, 569, 567

[56] References Cited

U.S. PATENT DOCUMENTS 5,288,598 2/1994 Sterman et al. ..... 430/496
5,476,761 12/1995 Verbeek et al. ..... 430/569

*Primary Examiner*—Thorl Chea
*Attorney, Agent, or Firm*—Jordan B. Bierman; Bierman, Muserlian and Lucas

[57] ABSTRACT

A silver halide photographic light sensitive material comprising a support having thereon photographic component layers including a light sensitive silver halide emulsion layer and a light insensitive hydrophilic colloid layer, wherein the silver halide emulsion layer comprises a silver halide emulsion which has been subjected to desalting by ultrafiltration, at least one of the component layers containing a composite material comprising a hydrophobic polymer and inorganic particles.

13 Claims, 1 Drawing Sheet

SILVER HALIDE PHOTOGRAPHIC LIGHT SENSITIVE MATERIAL

FIELD OF THE INVENTION

The present invention relates to a silver halide photographic light sensitive material whereby stable photographic performance and optimally-lustered silver image are obtained.

BACKGROUND OF THE INVENTION

In the course of preparation of a silver halide emulsion used for a silver halide photographic light sensitive material, particularly in the step of grain formation including physical ripening, a large amount of soluble salts, such as excessive halides, alkali nitrates and ammonium salts, are produced. As these salts are detrimental to photographic performance and photographic products, they are conventionally removed.

Flocculation washing method is cited as a representative desalting method. According to this method, a silver halide emulsion containing grains and gelatin is coagulated and allowed to form a sediment. The resulting supernatant containing soluble salts is removed and then the sediment is dispersed in water to form an emulsion. These procedures are repeated several times.

Although the flocculation method is sufficient in desalting effects, it has such a disadvantage that reproducibility with respect to the level of impurities such as soluble salts is deteriorated to the point that stable photographic performance including photographic sensitivity cannot be achieved. Further, another problem is that a coagulant used increases the viscosity of the emulsion, resulting in coating faults.

In view of the foregoing, as a desalting method not using coagulants, ultrafiltration (and alternatively, dialysis) are known.

Recently, JP-A 57-209823 and 6-308640 (the term, "JP-A" means an "unexamined published Japanese Patent Application") disclosed that, in the said method, stable photographic performance was achieved by monitoring the salt effluent from the outlet or the filtrate.

As a result of the inventor's study of this washing method, it was found that, although the method did not deteriorate photographic characteristics, it increased luster of a silver image. It has not yet been determined why the luster increased. According to the inventor's study, it was found that, as impurities were removed without the addition of a coagulant, light scattering in a hydrophilic layer was decreased so that the incident light on a photographic material processed was subject to reflection.

Excessively lustered silver images of X-ray photography are illegible which increase the chance of misdiagnosis. Accordingly, an improvement in less luster is desired.

SUMMARY OF THE INVENTION

An object of the present invention is to provide a silver halide photographic light sensitive material without fluctuation in sensitivity, whereby stable photographic performance and an optimally-lustered, legible silver image are obtained.

The object of the present invention can be accomplished by a silver halide photographic light sensitive material comprising a support having thereon photographic component layers including a light sensitive silver halide emulsion layer and a light insensitive hydrophilic colloid layer, wherein said silver halide emulsion layer comprises a silver halide emulsion which has been subjected to desalting by ultrafiltration to remove soluble salts, and at least one of the component layers containing a composite material comprised of a hydrophobic polymer and inorganic particles.

DETAILED DESCRIPTION OF THE INVENTION

Figure 1:
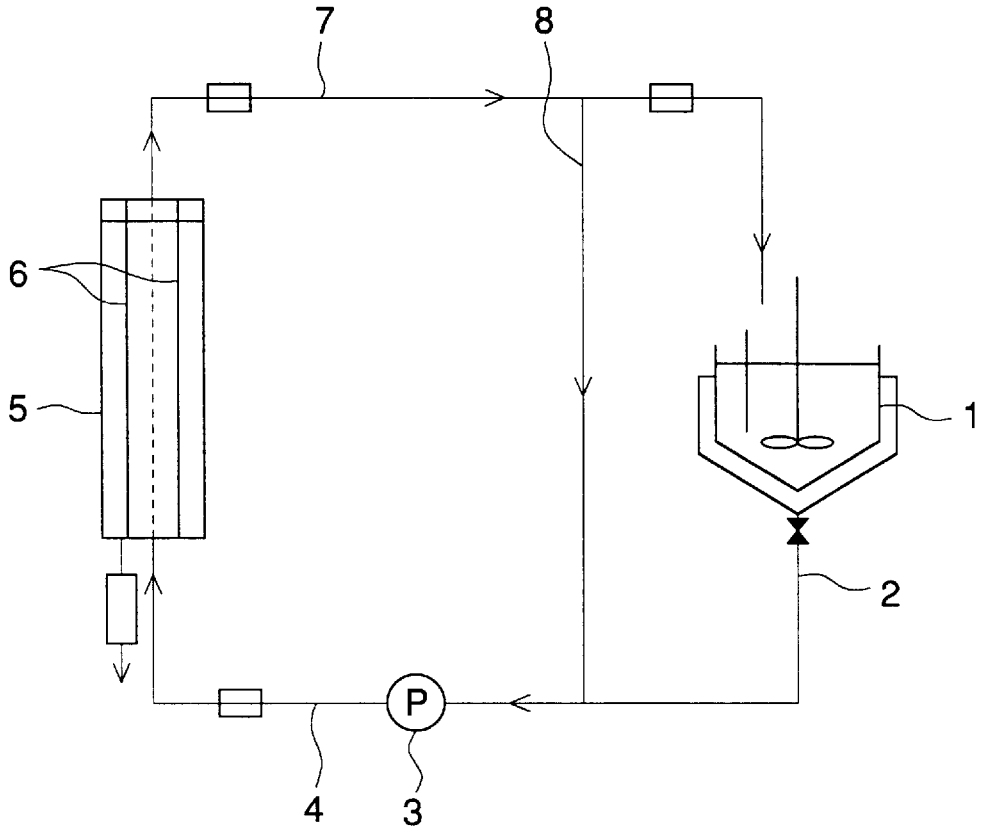
FIG. 1 is a schematic illustration of the desalting by ultrafiltration.

The term, "ultrafiltration" is used in the definition described in M. Cheyan, "Ultrafiltration Handbook" published by Technomic (1986). Ultrafiltration generally employs a membrane, which allows some material to pass through. When the ultrafiltration is applied to a silver halide emulsion, a membrane is employed which permits only excess salts to pass and restricts passage of necessary materials, such as silver halide grains.

The ultrafiltration includes washing of a silver halide emulsion and/or concentration thereof to remove excess soluble salts. A peptized silver halide emulsion is passed through a pressurized ultrafiltration module so that the excess salts pass through a semipermeable membrane to leave a residue comprised of a silver halide emulsion and peptizer.

Such selective separation is conducted by squeezing a solution, by hydraulic pressure, through a synthetic semipermeable membrane which allows only molecules smaller than a specified size to pass and molecules not smaller than the specified size to remain.

A silver halide grain emulsion containing a peptizer and excess salts are poured into a vessel by a conventional means. The emulsion is pumped, through a flowmeter, into the ultrafiltration module. Excess salts are removed as filtrate and the residue is introduced back to the vessel in a recycling operation mode.

The residue removed from the front module is transferred to an inlet line to the next module. Before a solution is subsequently flowed into the next module, the solution may be diluted with a washing solvent. In another mode, dilution is not desired, when the purpose is higher concentration.

There have been known various ultrafiltration methods. A method of using a ultrafiltration unit is explained as below.

FIG. 1 is a schematic illustration showing an example of desalting by an ultrafiltration apparatus (ultrafiltration membrane) used in the invention.

In FIG. 1, a physical-ripened silver halide emulsion in a reaction vessel (1) is introduced, through a bulb (2), into a ulrafiltration apparatus (5) by a pump (3) and some inorganic ions are separated as waste liquor by means of an ultrafiltration membrane (6) in a desalting process.

As shown in FIG. 1, the ultrafiltration apparatus (5) forms a closed loop together with pipes (4, 7, 8) and flow of the emulsion within the recycling loop is accomplished by the pump (3). The emulsion is repeatedly passed through the ultrafiltration apparatus and as a result, desalting is enhanced.

The ultrafiltration is preferably conducted in such a manner that a dispersing solution in the reaction vessel is cycled in contact with a semipermeable ultrafiltration membrane so as to produce a pressure difference across the semipermeable ultrafiltration membrane. The membrane permits molecules smaller than a specified size to pass and restricts molecules larger than that, and also silver halide grains within the dispersing solution. Appropriate membranes are selected from those having a molecular weight of 500 to 300,000, and preferably 500 to 50,000.

Pressure of the dispersing solution in contact with the ultrafiltration membrane is broadly variable. Exemplarily, the pressure applied to the reaction vessel in contact with the ultrafiltration membrane is 7.03 $kg/cm^2$ and the pressure at the outlet of the residue is 0.703 $kg/cm^2$ or less. Pressure difference between the inside and outside of the membrane is 2.81 to 4.22 $kg/cm^2$. The pressure can optionally be varied according to the structure of the reaction vessel and ultrafiltration membrane, viscosity of the dispersing solution, or concentration and desired purity of the residue.

The membrane used in the ultrafiltration has, as an exemplary example, double layer structure comprising a thick, porous layer provided thereon a very thin layer having micropore structure.

Usable membranes are various kinds of polymeric materials, including polyvinyl chloride, polyvinyl carboxylate, polyvinyl format, polyvinyl acetate, polyvinyl alcohol, polysulfone, polyvinyl ether, polyacrylamide, polyacrylonitrile, polymethacrylamide, polyimide, polyester, polyfluoroalkylene such as polytetrafluoroethylene or polyfluorovinylidene and cellulose polymers, such as cellulose, cellulose ester (e.g., cellulose acetate, cellulose butyrate).

The inorganic particles contained in the composite polymer material of the invention are metal oxides, nitrides and sulfides. Among these, metal oxides are preferable. The metal oxide is preferably an oxide of Na, K, Ca, Ba, Al, Zn, Fe, Cu, Ti, Sn, In, W, Y, Sb, Mn, Ga, V, Nb, Tu, Ag, Bi, B, Mo, Ce, Cd, Mg, Be, Pb, each or composite thereof. Among these oxides, oxide particles of Y, Sn, Ti, Al, V, Sb, In, Mn, Ce, B, Si, each or composite thereof are more preferable, from the point of miscibility with a silver halide emulsion.

The metal oxide particles may be crystalline or amorphous. The amorphous metal oxide is preferably used.

The metal oxide particles used in the invention have an average size of 0.5 to 3000 nm, preferably 3 to 1000 nm. Preferably, the metal oxide is dispersed in water or a solvent, such as alcohol including methanol, ethanol and isopropanol.

The metal oxide is contained in an amount of 1 to 2000%, preferably 30 to 1000% by weight of the hydrophobic polymer.

Exemplary examples of preferred metal oxides are shown below.

TABLE 1

| | | | | | |
|---|---|---|---|---|---|
| SO-1 | $SiO_2$ | SO-9 | $Al_2O_3$ | SO-17 | $Sb_2O_5$ |
| SO-2 | $TiO_2$ | SO-10 | $BeSiO_4$ | SO-18 | $Nb_2O_5$ |
| SO-3 | ZnO | SO-11 | $Al_2SiO_5$ | SO-19 | $Y_2O_3$ |
| SO-4 | $SnO_2$ | SO-12 | $ZrSiO_5$ | SO-20 | $CeO_2$ |
| SO-5 | MgO | SO-13 | $CaWO_4$ | SO-21 | $Sb_2O_3$ |
| SO-6 | $MnO_2$ | SO-14 | $CaSiO_3$ | SO-22 | $Na_2O$ |
| SO-7 | $Fe_2O_3$ | SO-15 | $InO_2$ | SO-23 | $V_2O_5$ |
| SO-8 | $ZnSiO_4$ | SO-16 | $SnSbO_2$ | SO-24 | $B_2O_3$ |

As hydrophobic monomer(s) forming the hydrophobic polymer are cited those including acrylates, methacrylates, vinyl esteres, olefines, stylenes, crotonates, itaconic acid diesters, fumaric acid diesters, maleic acid diesters, allyl compounds, vinyl ethers, vinylketones, vinyl heterocyclic compounds, glycidyl esters, unsaturated nitrites, each or a combination thereof. Among these monomers are preferable acrylates, methacrylates and/or methyl methacrylates and stylenes, their ester groups each preferably having 6 or more carbon atoms.

A hydrophobic monomer having a glycidyl group is preferably used in combination with these hydrophobic monomers, in proportion of at least 1.0 to 20% by weight, preferably 20 to 100% by weight.

In addition, a hydrophilic monomer is preferably copolymerized with the above-described hydrophobic monomers to form the hydrophobic polymer. As examples of the hydrophilic monomers are cited a carboxyl group containing monomer such as acrylic acid, methacrylic acid etc., hydroxy group containing monomer such as hydroxyethylacrylate, alkyleneoxide containing monomer, methacrylamide monomer, sulfonic acid group containing monomer and amino group containing monomer. Among these monomers are preferable a hydroxy group containing monomer, carboxyl group containing monomer, amido group containing monomer and sulfonic acid group containing monomer. These monomers are contained in proportion of 0.1 to 30% by weight, preferably 1 to 20% by weight.

The composite polymer material used in the invention can become one having a cross-linking group by optimally selecting the kind of the above-described hydrophobic monomer and/or hydrophilic monomer, for example, by using a hydrophobic monomer having a cross-linking group , such as carboxyl group, glycidyl group, amino group, amido group or N-methylol group.

The polymer contains preferably an unsaturated monomer having at least two ethylenic group capable of copolymerization. As examples of such monomers are cited ones having two vinyl groups, such as divinylbenzene, ethylene glycol diacrylate, ethylene glycol dimethacrylate, diethylene glycol diacrylate, diethylene glycol dimethacrylate, N,N-methylenebisacrylamide; ones having three vinyl groups, such as trivinyl cyclohexane, trimethylolpropane triacrylate, trimethylolpropane trimethacrylate, pentaerythritol trimethacrylate; and ones having four vinyl groups, such as pentaerythritol tetraacrylate and pentaerythritol tetramethacrylate.

The composite polymer material used in the invention is preferably in the form of solid particles. The average size of the composite polymer particles is preferably 0.005 to 3.0 $\mu$m, more preferably 0.01 to 0.8 $\mu$m in terms of a weight-averaged grain diameter.

As polymerization methods of the composite polymer can be polymerized are cited an emulsion polymerization method, solution polymerization method, block polymerization, suspension polymerization method and radiation polymerization. In the solution polymerization, a mixture of monomers dissolved in a solvent in a optimal concentration (conventionally, 40 wt. % or less of the solvent, preferably 10 to 25 wt. %) is subjected to polymerization, in the presence of an initiator, at 10° to 200° C. (preferably 30° to 120° C.) for 0.5 to 48 hours (preferably, 2 to 20 hours).

The initiator may be any one which is soluble in a polymerization solvent. As examples thereof are cited organic solvent-soluble initiators including benzoyl peroxide, azobisisobutyronitrile (AIBN), di-tert-butyl peroxide etc.; water-soluble initiators including ammonium persulfate (APS), potassium persulfate, 2,2'-azobis-(2-amidinopropane)-hydrochloride; and redox type initiators, such as the above-described initiator combined with a reducing agent such as $Fe^{2+}$ salts or sodium hydrogencarbonate.

As examples of the solvent are cited water, methanol, ethanol, dimethylsulfoxide, dimethylformamide and dioxane. After completing polymerization, a reaction mixture is poured into a medium which does not dissolve the resulting polymer to have the polymer sedimented. The mixture is dried to remove unreacted residue.

In the emulsion polymerization, water is used as a dispersing medium. Monomers of 10 to 50 wt. % of water, together with a polymerization initiator and a dispersing agent of 0.05 to 5 wt. % and 0.1 to 20 wt. % of the monomer, respectively, are subjected to polymerization at 30° to 100° C. (preferably, 60° to 90° C.) for 3 to 8 hours with stirring to obtain a polymer.

The concentration of the monomer, amount of the initiator, reaction temperature and time can be broadly varied.

As the dispersing agent, any of anionic surfactants, nonionic surfactants, cationic surfactants and amphoteric surfactants may be usable. Anionic or nonionic surfactants are preferable.

A water soluble polymer may usable as the dispersing agent. The water soluble polymer includes water soluble synthetic polymer or water soluble natural polymer. The water soluble synthetic polymer includes ones having, in the molecule, a nonionic group, anionic group, cationic group, both nonionic and anionic groups, both nonionic and cationic groups or both anionic and cationic groups.

As the nonionic group is cited an ether group, alkyleneoxide group, hydroxy group, amido group or amino group. As the anionic group is cited carboxylic acid group including its salt, phosphoric acid group including its salt or sulfonic acid group including its salts. As the cationic group is cited quaternary ammonium salt group or tertiary amino group.

The water soluble natural polymer includes ones having, in the molecule, a nonionic group, anionic group, cationic group, both nonionic and anionic groups, both nonionic and cationic groups or both anionic and cationic groups.

As the water soluble polymer which may be a synthetic or natural polymer are preferable ones having an anionic group or both nonionic and anionic groups.

In the invention, the water soluble polymer is referred to as a polymer having solubility to water, of 0.05 g or more, preferably 0.1 g or more per water of 100 g at 20° C.

As the synthetic water-soluble polymer is preferable a polymer having a repeating unit represented by the following formula (I) and/or (II), in an amount of 10 to 100% a polymer molecule.

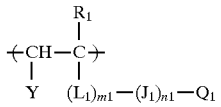

Formula (I)

In the formula, $R_1$ represents a hydrogen atom, alkyl group, halogen atom or —$CH_2COOM$ group, preferably an alkyl group having 1 to 4 carbon atoms. $L_1$ represents bivalent linkage group, such as —CONH—, —NHCO—, —COO—, —OCO—, —CO— or —O—. $J_1$ represents an alkylene group, arylene group or oxyalkylene group. $Q_1$ represents —OM, —$NH_2$, $SO_3M$, —COOM,

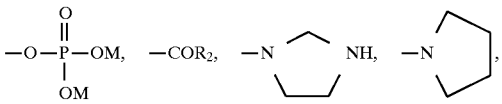

-continued

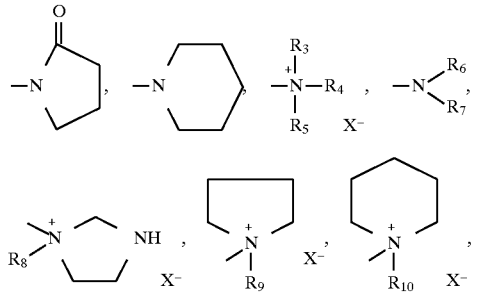

hydrogen atom or $R_3$, and among these are preferable —COOM or —$SO_3M$, more preferable —$SO_3M$. M represents a hydrogen atom or cation (e.g., alkali metal ions, ammonium ion); $R_2$, $R_3$, $R_4$, $R_5$, $R_6$, $R_7$, $R_8$, $R_9$ and $R_{10}$ each represents an alkyl group having 1 to 20 carbon atoms; X represents an anion; $m_1$ and $n_1$ each are 0 or 1.

Y represents a hydrogen atom or -$(L_2)m_2$-$(J_2)n_2$-$Q_2$; $L_2$, $J_2$, $Q_2$, $m_2$, $n_2$ are respectively the same as defined $L_1$, $J_1$, $Q_1$, $m_1$, $n_1$.

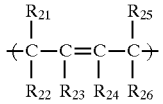

Formula (II)

In the formula, $R_{21}$, $R_{22}$, $R_{23}$, $R_{24}$ $R_{25}$and $R_{26}$ represents a hydrogen atom, alkyl group having 1 to 8 carbon atoms, aryl group having 6 to 20 carbon atoms or —$SO_3X$, in which X represents a hydrogen atom, alkali metal atom, alkaline earth metal atom, ammonium group or amino group, provided that at least one of $R_{21}$, $R_{22}$, $R_{23}$, $R_{24}$ $R_{25}$ and $R_{26}$ is —$SO_3X$.

The synthetic water-soluble polymer having a repeating unit represented by formula (1) and/or (2) may be a homopolymer comprised of the unit represented by formula (1) and/or (2), or may contain further another component.

As examples of said another component are cited acrylates, methacrylates, vinyl esteres, olefines, stylenes, crotonates, itaconic acid diesters, maleic acid diesters, fumaric acid diesters, allyl compounds, vinyl ethers, vinylketones, vinyl heterocyclic compounds, glycidyl esters, unsaturated nitrites, each or a combination thereof. Among these monomers are preferable acrylates, methacrylates and stylenes.

Example of the water-soluble synthetic polymer of formulas (1) and (2) are shown below.

SP-1

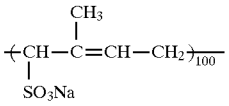

Weight-averaged molecular weight (Mw): 20000

SP-2

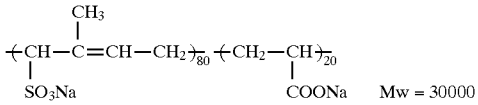

Mw = 30000

-continued

SP-3

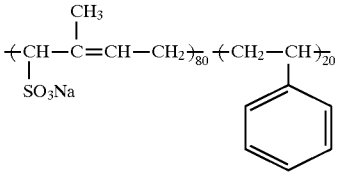

Mw = 40000

SP-4

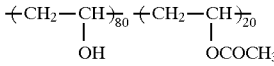

Mw = 40000

SP-5

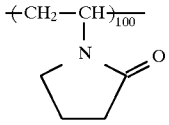

Mw = 9000

SP-6

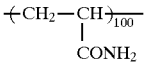

Mw = 20000

SP-7

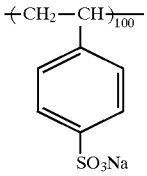

Mw = 10000

SP-8

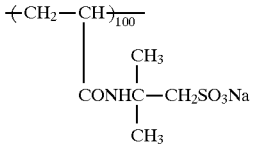

Mw = 20000

SP-9

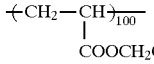

Mw =10000

SP-10

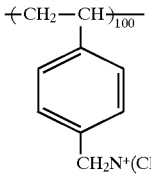

Mw = 150000

SP-11

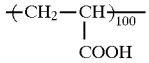

Mw = 40000

SP-12

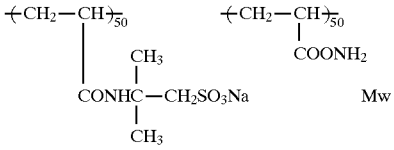

Mw = 40000

SP-13

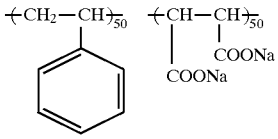

Mw = 5000

SP-14

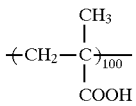

Mw = 20000

The water soluble natural polymer is described in details in Sohgo Gijutsu Shiryo-shu (Keieikaihatsu Center). Preferable examples include lignin, starch, pullulan, cellulose, dextran, dextrin, glycogen, alginic acid, gelatin, collagen, guar gum, gum arabic, laminaran, lichenin, nigran, each or derivative thereof. As derivatives of the water soluble natural polymer are cited sulfonated, carboxylated, phosphated, sulfonalkylenated, carboxyalkylenated or alkylphosphonated ones including salts thereof. Glucose, gelatin, dextran, cellulose, pullulan, glucomannan, dextrin, geran gum, xanthane gum and their derivatives are preferable.

The composite polymer material preferably contains a metal alkoxide compound. Thus, the hydrophobic polymer is polymerized preferably in the presence of the metal alkoxide compound. The metal alkoxide compound includes so-called coupling agents. A variety of the coupling agents, such as silane coupling agent, titanium coupling agent, aluminum coupling agent and zirconium coupling agent are commercially available. Among these are preferable a silane coupling agent and titanium coupling agent.

Examples of preferred metal alkoxide compounds are shown below.

ST-1 $Si(OCH_3)_4$

ST-2 $Ti(OC_3H_7(i))_4$

ST-3

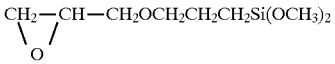

ST-4 $HSCH_2CH_2CH_2Si(OCH_3)_2$

ST-5

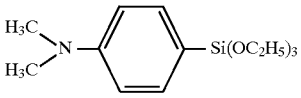

ST-6

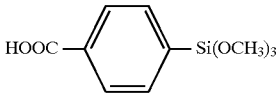

ST-7

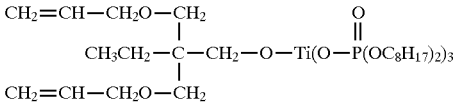

ST-8

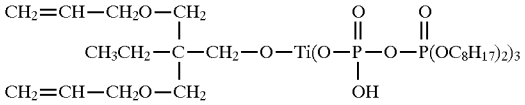

ST-9

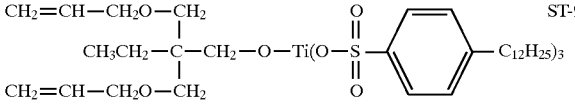

ST-10

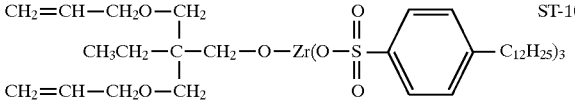

ST-11

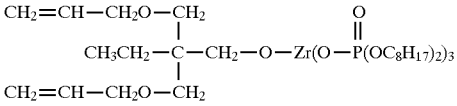

ST-12

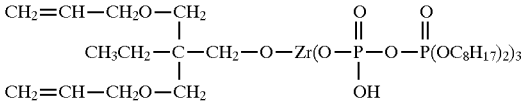

ST-13 $C_{10}H_{21}Si(OCH_3)_3$

ST-14 $CH_3(CH_2)_7Si(OC_2H_5)_3$

ST-15 $CH_2{=}CHSi(OC_2H_4OCH_3)_3$

ST-16

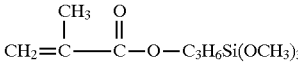

-continued $NH_2-C_2H_4-NHC_3H_6Si(OCH_3)_3$ ST-17

$NH_2-C_2H_4-NHC_3H_6-Si(CH_3)(OCH_3)_2$ ST-18

$(CH_3O)_3Si-C_3H_6-NH-C_2H_4-NH_2CH_2COOH$ ST-19

$(CH_3O)_3Si-C_3H_6-NH-C_2H_4-NH-CH_2-CH=CH_2$ ST-20

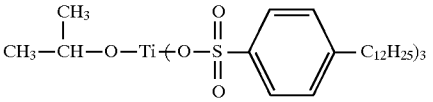
ST-21

$CH_3-CH(CH_3)-O-Ti(O-S(=O)_2-C_6H_4-C_{12}H_{25})_3$ ST-22

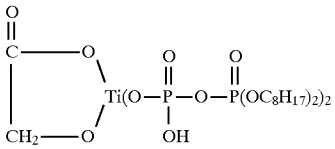
ST-23

$(C_8H_{17}-O)_4Ti(P(O-C_{13}H_{27})_2OH)_2$ ST-24

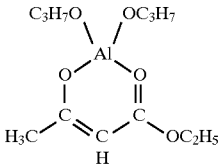
ST-25

The composite polymer is contained in a photographic component layer as such or in the form of aqueous dispersion. The polymer can be dispersed by means of a ultrasonic homogenizer, ball mill, atreiter, pearl mil, roll mill and high-speed grinder.

The composite polymer is contained in the photographic component layer, in an amount of 5 to 300 wt. %, preferably 10 to 150 wt. % of binder used in the component layer. It may be contained in a light sensitive layer or light insensitive layer.

Next, synthesis of the composite polymer material used in the invention will described, as below.

Synthesis of composite polymer material

Synthetic Example 1 (Synthesis of PL-1)

To 1000 ml four-necked provided with a stirrer, thermometer, dropping funnel, nitrogen-introducing tube and reflux condenser were added 125 ml of distilled water and 225 g of 20 wt. % antimonyl oxide sol (SO-17), while introducing nitrogen gas to degas oxygen, and the mixture was heated until internal temperature reached 80° C. 4.5 g of surfactant (SF-1) as a dispersing agent and 0.45 g of ammonium persulfate, as an initiator were added thereto and then 45 g of methyl methacrylate was dropwise added with a dropping funnel taking ca. 1 hour. After addition, the mixture was allowed to be reacted over a period of 5 hours. Thereafter, the reaction mixture was cooled and adjusted to a pH of 6 with an aqueous ammonia solution to obtain composite polymer PL-1.

SF-1 $p-C_9H_{19}-(C_6H_4)O(CH_2CH_2O)_6(CH_2)_3SO_3Na$

Synthesis Example 2 (Synthesis of PL-3)

To 1000 ml four-necked provided with a stirrer, thermometer, dropping funnel, nitrogen-introducing tube and reflux condenser were added 125 ml of distilled water and 225 g of 10 wt. % tin oxide sol (SO-4), while introducing nitrogen gas to degas oxygen, and the mixture was heated until internal temperature reached 80° C. Hydroxypropyl cellulose of 4.5 g was further added thereto. Ammonium persulfate of 0.45 g, as an initiator was added thereto and then 16 g of hydroxyethyl methacrylate was dropwise added with a dropping funnel taking ca. 1 hour. After addition, the mixture was allowed to be reacted over a period of 4 hours. Thereafter, the reaction mixture was cooled and adjusted to a pH of 6 with an aqueous ammonia solution to obtain composite polymer PL-3.

Exemplary examples of the composite polymer materials usable in the present invention are shown as below. In addition, alkoxides and dispersing agents which were used in the preparation of the composited polymer material were also shown below. The composite material used in the present invention is not limited these examples.

| No. | Polymer composition | Inorganic particles (wt. %, based on polymer) | | Metal alkoxide (wt. %, based on polymer) | | Dispersing agent (wt. %, based on polymer) | |
|---|---|---|---|---|---|---|---|
| PL-1 | $(CH_2-C(CH_3)(COOCH_3))_{100}$ | SO-17 | 100 | — | — | SF-1 | 10 |
| PL-2 | $(CH_2-C(CH_3)(COOCH_3))_{80}$ $(CH_2-C(CH_3)(COOCH_2CH_2OH))_{20}$ | SO-1 | 100 | — | — | SP-5 | 5 |
| PL-3 | $(CH_2-C(CH_3)(COOCH_3))_{80}$ $(CH_2-C(CH_3)(COOCH_2CH_2OH))_{20}$ | SO-4 | 123 | — | — | Hydroxypropyl cellulose | 22 |
| PL-4 | $(CH_2-CH(COOEt))_{90}$ $(CH_2-C(CH_3)(COOCH_2CH_2OH))_{10}$ | SO-1 | 200 | — | — | SF-1<br>SP-4 | 1<br>5 |

-continued

| No. | Polymer composition | Inorganic particles (wt. %, based on polymer) | | Metal alkoxide (wt. %, based on polymer) | | Dispersing agent (wt. %, based on polymer) | |
|---|---|---|---|---|---|---|---|
| PL-5 | $\leftarrow CH_2-CH\rightarrow_{98}$ (COOEt) $\leftarrow CH_2-CH\rightarrow_{2}$ (COOH) | SO-1 | 200 | — | — | SP-4<br>SF-1 | 4<br>5 |
| PL-6 | $\leftarrow CH_2-C(CH_3)\rightarrow_{80}$ (COO–H) $\leftarrow CH_2-C(CH_3)\rightarrow_{20}$ ($COOC_9H_{19}$(i)) | SO-1 | 200 | ST-3 | 5 | SP-4 | 10 |
| PL-7 | $\leftarrow CH_2-CH\rightarrow_{93}$ (COOEt) $\leftarrow CH_2-C(CH_3)\rightarrow_{7}$ ($COOCH_2CH_2OOC$–$\leftarrow C(CH_3)-CH_2\rightarrow$) | SO-1 | 300 | ST-16 | 5 | SP-3 | 10 |
| PL-8 | $\leftarrow CH_2-CH\rightarrow_{80}$ (COOnBu) $\leftarrow CH_2-C(CH_3)\rightarrow_{20}$ ($COOCH_2CH-CH_2$ O) | SO-19 | 100 | — | — | SP-3 | 10 |
| PL-9 | $\leftarrow CH_2-CH\rightarrow_{40}$ ($COOC_9H_{19}$(i)) $\leftarrow CH_2-C(CH_3)\rightarrow_{60}$ ($COOCH_3$) | SO-4 | 200 | — | — | SF-1 | 10 |
| PL-10 | $\leftarrow CH_2-C(CH_3)\rightarrow_{50}$ (COO–H) $\leftarrow CH_2-C(CH_3)\rightarrow_{50}$ ($COOCH_2CH-CH_2$ O) | SO-1 | 600 | — | — | SP-3 | 10 |
| PL-11 | $\leftarrow CH_2-C(CH_3)\rightarrow_{80}$ (COO–H) $\leftarrow CH_2-C(CH_3)\rightarrow_{20}$ ($COOCH_2CH_2OH$) | SO-4 | 200 | ST-16 | 5 | SP-6 | 10 |
| PL-12 | $\leftarrow CH_2-C(CH_3)\rightarrow_{60}$ (COO–H) $\leftarrow CH_2-CH\rightarrow_{30}$ ($COOC_9H_{19}$(i)) $-CH_2-C(CH_3)\rightarrow_{10}$ ($COOCH_2CH-CH_2$ O) | SO-1 | 200 | ST-16 | 1 | SP-3 | 10 |
| PL-13 | $\leftarrow CH_2-CH\rightarrow_{80}$ ($COOC_9H_{19}$(i)) $\leftarrow CH_2-C(CH_3)\rightarrow_{20}$ ($COOCH_3$) | SO-20 | 100 | — | — | SF-1 | 10 |

As binder of a silver halide emulsion layer relating to the invention are advantageously employed gelatin and derivatives thereof.

As gelatin are usable lime-treated gelatin, acid-treated gelatin disclosed in Bull. Soc. Sci. Photo. Japan, No.16 page 30 (1966), hydrolysis product of gelatin or enzyme-treated gelatin. As gelatin derivatives are employed those prepared by reacting the gelatin with acid halides, acid anhydride, isocyanates, bromoacetic acid, alkane saltones, vinylsulfonamides, maleimide, polyalkylene oxides or epoxy compounds. Exemplary examples thereof are disclosed U.S. Pat. Nos. 2,614,928, 3,132,945, 3,186,846, and 3,312,553, British Patent 861,414, 1,033,189 and 1,005,784 and Japanese Patent examined 42-26845.

Silver halide of a silver halide emulsion used in the invention is optionally selected from silver chloride, silver iodochloride, silver chlorobromide, silver bromide, silver iodobromide, silver iodochlorobromide. The iodide content is preferably 1.0 mol % or less, more preferably 0.5 mol % or less.

The average grain size of silver halide grains used in the invention is preferably 0.15 to 5.0 mm, more preferably 0.2 to 3.0 μm and further more preferably, 0.2 to 2.0 μm.

The shape of silver halide grains may be cubic, octahedral or any form, and tabular silver halide grains are preferable.

The tabular silver halide grains refer to grains having two major faces parallel with each other, which may be (111) face or (100) face. The tabular silver halide grains usable in the invention have preferably a ratio of grain thickness to grain diameter (hereinafter, referred to as aspect ratio) of 2 or more, preferably not less than 2.0 and less than 15.0, more preferably not less than 3 and less than 10.

The grain diameter refers to an average projected area diameter, which is represented as circular equivalent diameter of the projected area of the grain (thus, a diameter of a circle having the same area as the projected area of the grain). The thickness refers to a distance between two parallel major faces of the tabular grain.

The average thickness of the tabular silver halide grains used in the invention is preferably 0.01 to 1.0 μm, more preferably 0.02 to 0.60 μm and further more preferably 0.05 to 0.50. The average grain diameter is preferably 0.15 to 5.0 μm, more preferably 0.4 to 3.0 μm and further more preferably 0.4 to 2.0 μm. The tabular silver halide grains are preferably monodispersed. Thus, the width of grain size distribution as defined below is 25% or less, more preferably 20% or less and further more preferably 15% or less.

(Standard deviation of grain diameter/average grain diameter)×100=width of grain size distribution (%)

Silver halide grains used in the invention may have dislocation line(s). The dislocation line can be observed using an electronmicroscope at low temperature, as described in J. F. Hamilton, Phot. Sci. Eng., 57 (1967) and T. Shiozawa, J. Soc. Phot. Sci. Japan, 35, 213 (1972).

The tabular silver halide grains can be prepared, with reference to U.S. Pat. No. 5,320,938. Thus, nuclear grains are preferably formed in the presence of iodide ions at a low pCl under such a condition as to form (100) face. After nucleus formation, the nuclear grains are further subjected to Ostwald ripening and/or grain growth to obtain tabular silver halide grains with desired size and size distribution.

The tabular silver halide grains can occlude a metal ion in the interior or exterior of the grain by adding a metal ion selected from a cadmium salt, zinc salt, lead salt, thallium salt, iridium salt including its complex salt and rhodium salt including its complex salt during the course of grain formation.

Chemical ripening conditions of a silver halide emulsion used in the invention, such as pH, pAg, temperature and time are not specifically limited and therefore the chemical ripening can be carried out in a manner conventional in the art.

Sulfur sensitization by the use of a sulfur compound capable of reacting with a silver ion or active gelatin, selenium sensitization by the use of a selenium compound, tellurium sensitization by the use of a tellurium compound, reduction sensitization by the use of a reducible compound and novel metal sensitization by the use of a novel metal such as gold can be used singly or in combination thereof.

Selenium sensitization includes a variety of selenium sensitizers, as disclosed in U.S. Pat. Nos. 1,574,944, 1,602,592, 1,623,499, JP-A 60-150046, 4-25832, 4-109240 and 4-4-147250.

Usable selenium sensitizers include colloidal selenium, isoselenocyanates (e.g., allyl isoselenocyanate), selenoureas (e.g., N,N-dimethylselenourea, N,N,N'-triethylselenourea, N,N,N'-trimethyl-N'-heptafluoroselenourea, N,N,N'-trimethyl-N'-heptafluoropropylcarbonylselenourea, N,N,N'-trimethyl-N'-4-nitrophenylcarbonylselenourea), selenoketones (e.g., selenoacetone, selenoacetophenone), selenoamides (e.g., selenoacetoamide, N,N-dimethylselenobenzamide), selenocarboxylic acids and selenoesters (e.g., 2-selenopropionic acid methy-3-selenobutyrate), selenophosphates (tri-p-triselenophosphate) and selenides (triphenyphosphineselenide, diethylselenide, diethyldiselenide). Among these sensitizers are preferable selenoureas, selenoamides, selenoketones and selenides.

The amount of the selenium sensitizer to be used depends on a selenium compound, silver halide grains and chemical ripening conditions, and in general, are within a range of $10^{-8}$ to $10^{-4}$ mol per mol of silver halide. According to properties of a selenium compound to be used, it may be added by a method in which it is dissolved in water or an organic solvent such as methanol or ethanol, a method in which it has been previously mixed a gelatin solution, by a method disclosed in JP-A 4-140739, thus in the form of a dispersion of mixture solution with an organic solvent-soluble polymer.

Chemical ripening with a selenium sensitizer is carried out at a temperature of 40° to 90° C., preferably 45° to 80° C., and a pH of 4 to 9, preferably 6 to 9.5.

Tellurium sensitizers and sensitizing methods are described in U.S. Pat. Nos. 1,623,499, 3,320,069, 3,772,031, 3,655,394, British Patent 235,2111, 1,121,496, 1,295,462, 1,396,696, Canada Patent 800,958, JP-A 4-204640 and 4-333043. As examples of usable tellurium sensitizers are cited tellurureas (e.g., N,N-dimethyltellurourea, tetramethyltellurourea, N-carboxyethyl-N,N'-dimethyltellurourea, N,N'-dimethyl-N'-phenyltellurourea), phosphinetellurides (e.g., tributylphosphinetelluride, tricyclohexylphosphinetelluride, triisopropylphosphinetelluride, butyldiisopropylphosphinetelluride, dibutylphenylphosphinetelluride), telluroamides (e.g., telluroacetoamide, N,N-dimethyltellurobenzamide), telluroketones, telluroesters, isotellurocyanates.

The tellurium sensitizer can be used in a manner similar to the selenium sensitizer.

The silver halide emulsion used in the invention can be subjected to reduction sensitization. As examples of a reducing agent are cited thiourea dioxide, ascorbic acid and derivatives thereof, hydrazines, polyamines such as diethylenetriamine, dimethylamine borane, and sulfites.

To a silver halide emulsion used in the photographic material of the invention are added various kinds of photographic additives at a time before, during or after physical ripening or chemical ripening. As the additives, can be employed compounds as described in afore-mentioned RD No. 17643, 18716 and 308119, wherein relevant types of compounds and sections thereof are follows.

| | RD-17643 | | RD-18716 | RD-308119 | |
|---|---|---|---|---|---|
| Additive | Page | Sec. | Page | Page | Sec. |
| Chemical sensitizer | 23 | III | 648 upper right | 996 | III |
| Sensitizing dye | 23 | IV | 648–649 | 996–8 | IVA |
| Desensitizing dye | 23 | IV | | 998 | IVB |
| Dye | 25–26 | VII | 649–650 | 1003 | VIII |
| Developing accelerator | 29 | XXI | 648 upper right | | |
| Antifoggant/stabilizer | 24 | IV | 649 upper right | 1006–7 | VI |
| Brightening agent | 24 | V | | 998 | V |
| Hardening agent | 26 | X | 651 left | 1004–5 | X |
| Surfactant | 26–27 | XI | 650 right | 1005–6 | XI |
| Plasticizer | 27 | XII | 650 right | 1006 | XII |
| Slipping agent | 27 | XII | | | |
| Matting agent | 28 | XVI | 650 right | 1008–9 | XVI |

-continued

| Additive | RD-17643 Page | RD-17643 Sec. | RD-18716 Page | RD-308119 Page | RD-308119 Sec. |
|---|---|---|---|---|---|
| Binder | 26 | XVII | | 1003–4 | IX |
| Support | 28 | XVII | 1009 | XVII | |

As supports used in the photographic material of the invention are cited those described in afore-mentioned RD17643, page 28 and RD-308119, page 1009. As an optimal support is cited polyethylene terephthalate film. The surface of the support may be sub-coated or exposed to corona discharge or UV-ray.

The silver halide photographic light sensitive material of the invention can be processed with processing solutions, as described in the afore-described RD-17643, XX–XXI, pages 29–30 and RD-308119, XX–XXI, pages 1011–1012. The processing may be black-and-white photographic processing for forming silver images or color photographic processing for forming color dye images. The processing is conducted at a temperature of 18° to 50° C.

As a developing agent of the black-and-white photographic processing are usable dihydroxybenzenes (e.g., hydroquinone), 3-pyrazolidones (e.g., 1-phenyl-3-pyrazolidone), aminophenols (e.g., N-methyl-p-aminophenol), each or a combination thereof. A developer may optionally contain a preservative, alkali agent, pH buffer, antifoggant, hardener, development accelerator, surfactant, defoamer, color toning agent, water-softener, dissolving aid or thickener.

In a fixer is used a fixing agent, such as a thiosulfate and thiocyanate. The fixer may contain, as a hardener, a water-soluble aluminium salt, as a hardener, such as aluminium sulfate or potassium alum; and a preservative, pH-adjusting agent or water-softener.

The silver halide photographic light sensitive material of the invention may be processed with an automatic processor. Processing of from developing to drying is completed preferably within a time of 15 to 90 seconds. Thus, the period of from the time when the top of the photographic material is dipped in the developer to the time when the top of the photographic material comes out from a drying zone (so-called Dry to Dry Time) is preferably 90 seconds or less, more preferably 60 seconds or less.

The developing time and temperature are respectively 5 to 45 seconds and 25° to 50° C., preferably, 8 to 30 seconds and 30° to 40° C. The fixing time and temperature are respectively 6 to 20 seconds and 20° to 50° C., preferably, 6 to 15 seconds and 30° to 40° C. The drying temperature is 35° to 100° C., preferably 40° to 80° C.

The processor may be further provided with a means for providing water or an acidic rinsing solution between steps of developing, fixing and washing. Furthermore, a device for preparing a developer or fixer may be built in the processor.

EXAMPLES

Embodiments of the present invention will be explained as below, but the invention is not limited thereto.

Example 1

Preparation of seed emulsion-1

Seed emulsion-1 was prepared in the following manner.

| | |
|---|---|
| Solution A1 | |
| Ossein gelatin | 24.2 g |
| Water | 9657 ml |
| Sodium polyisopropylene-polyethyleneoxy-disuccinate (10% ethanol solution) | 6.78 ml |
| KBr | 10.8 g |
| 10% Nitric acid | 114 ml |
| Solution B1 | |
| 2.5 N $AgNO_3$ aqueous solution | 2825 ml |
| Solution C1 | |
| KBr | 841 g |
| Water to make | 2825 ml |
| Solution D1 | |
| 1.75 N KBr aqueous solution for adjusting Ag potential | |

To Solution A1 maintained at 42° C. were added Solutions B1 and C1, each 464.3 ml for 1.5 min., with stirring by a mixer described in Japanese Patent 58-58288 and 58-58299 to form nuclear grains Thereafter, Solution A1 was heated to 60° C. taking 60 min. After adjusting the pH to 5.0, solutions B1 and C1 were simultaneously added thereto at a flow rate of 55.4 ml/min. over a period of 42 min. During the course of a temperature-increase of 42° to 60° C. and addition of Solutions B1 and C1, Ag-potential was controlled at ±8 mV and +16 mV with Solution D1, respectively. After completing addition, the pH was adjusted to 6 with 3% KOH aqueous solution and the resulting emulsion was desalted to obtain a seed emulsion-1. The emulsion was proved to be comprised of hexagonal tabular grains accounting for 90% of the projected area of total grains and having a maximum adjacent edge ratio of 1.0 to 2.0, an average thickness of 0.064 μm, an average diameter (circular equivalent diameter) of 0.595 μm, a variation coefficient of thickness of 40% and a variation coefficient of spaces between twin planes of 42%.

A silver halide tabular grain emulsion Em-1 was prepared in the following manner.

| | |
|---|---|
| Solution A2 | |
| Ossein gelatin | 34.03 g |
| Sodium polyisopropylene-polyethyleneoxy-disuccinate (10% ethanol solution) | 2.25 ml |
| Seed emulsion | 1.218 mole eq. |
| Water to make | 3150 ml |
| Solution B2 | |
| KBr | 1734 g |
| Water to make | 3644 ml |
| Solution C2 | |
| $AgNO_3$ | 2478 g |
| Water to make | 4165 ml |
| solution D2 | |
| Fine grain emulsion comprised of silver iodide grains (av. size, 0.05 μm) and 3 wt. % gelatin | 0.08 mol eq. |

Preparation of silver iodide fine grain emulsion

To 6.64 l of a 5.0% gelatin solution containing 0.06 mol Of potassium iodide were added an aqueous solution containing 7.06 mol of silver nitrate and aqueous solution containing 7.06 mol of potassium iodide, each 2 l over a period of 10 min. During addition, the pH was adjusted to 2.0 with nitric acid and the temperature was adjusted to 40° C. After completing addition, the pH was adjusted to 6.0 with an aqueous sodium carbonate solution.

To Solution A2 in a reaction vessel maintained at 60° C. with vigorously stirring were simultaneously added a portion of each Solution B2 and C2 and half of Solution D2 over a period of 5 min. Subsequently, halves of residual volume of Solutions B2 and C2 were added over a period of 37 min., then, portions of Solutions B2 and C2, and the residual of Solution D2 were simultaneously added over a period of 15 min. and finally the residual of Solutions B2 and C2 were simultaneously added over a period of 33 min.

During addition, the pH and pAg were respectively maintained at 5.8 and 8.8. Solutions B2 and C2 each were added at an accelerated flow rate so as to conform to the critical growing rate.

Further, Solution D2 of 0.15 mol equivalent per total silver content was added thereto. After completing addition, the resulting emulsion was cooled to 40° C. and, as a polymer coagulant, 1800 ml of an aqueous 13.8% (by weight) solution of modified gelatin which has been substituted by phenylcarbamoyl group (substitution ratio of 90%) was added thereto and the emulsion was stirred further for 3 min. Then, 56% acetic acid solution was added to adjust the pH to 4.6. After stirring for 3 min., the emulsion was allowed to stand for 20 min. and the supernatant was decanted. Then, 9.0 l of distilled water kept at 40° C. was added and after stirring and standing, the supernatant was decanted. Furthermore, 11.25 l of distilled water was added and, after stirring and standing, the supernatant was decanted. Then, gelatin aqueous solution was added and the pH was adjusted to 5.80 with an aqueous 10 wt. % sodium carbonate solution and the emulsion was stirred at 50° C. for 30 min. to be dispersed. After dispersing, the pH and pAg was respectively adjusted to 5.80 and 8.06 at 40° C.

The resulting emulsion was comprised of tabular silver halide grains having an average diameter of 1.11 $\mu$m, an average thickness of 0.25 $\mu$m, an average aspect ratio of 4.5 and a width of grain size distribution of 18.1%. It was proved that grains having a ratio of grain thickness to a distance between twin planes of 5 or more accounted for 97% by number of total grains; grains having 10 or more, 49%; and grains with 15, 17%.

Preparation of Emulsion Em-2

Emulsion Em-2 was prepared in the same manner as in emulsion Em-1, except that desalting was carried out by ultrafiltration in the following manner.

According to the ultrafiltration apparatus as shown in FIG. 1, a silver halide emulsion contained in reaction vessel (1) is introduced, at 45° C., into a ultrafiltration apparatus (5) by a pump (3) and cycled, through pipes, from the ultrafiltration apparatus. Water and salts dissolved therein which passed through a ultrafiltration membrane (6) were removed. As the ultrafiltration membrane was employed polyacrylonitrile semipermeable membrane produced by Asahi Kasei Co., ltd.

According to electronmicroscopic observation, the resulting emulsion was comprised of tabular silver halide grains having an average diameter of 1.11 $\mu$m, an average thickness of 0.25 $\mu$m, an average aspect ratio of 4.5 and a width of grain size distribution of 18.1%. It was proved that grains having an average value of distances between twin planes of 0.02 $\mu$m and a ratio of grain thickness to a distance between twin planes of 5 or more accounted for 97% by number of total grains; grains having 19 or more, 49%; and grains with 15, 17%.

Chemical sensitization

To each of the emulsions Em-1 and Em-2 maintained at 60° C., spectral sensitizing dyes, anhydro-5,5'-dichloroethyl-3,3'-di-(3-sulfopropyl)-oxacarbocyanine hydroxide (400 mg per mol of silver halide) and anhydro-5,5'-di-(butoxycarbonyl)-1,1'-diethyl-3,3'-di-(3-sulfopropyl)-benzoimidazolocarbocyanine hydroxide (4 mg per mol of silver halide) were added in the form of a solid particle dispersion. Thereafter, a mixture solution of adenine, ammonium thiocyanate, chloroauric acid and sodium thiosulfate, and a dispersion of triphenylphosphine selenide were added in amount as below.

30 minutes later after the addition thereof, a silver iodide fine grain emulsion was added to the emulsion in an amount of $4.0\times10^{-3}$ mol per mol of silver halide and the emulsion was further ripened for 2 hours. After completing ripening, 4-hydroxy-6-methyl-1,3,3a,7-tetrazaindene (TAI) was added to stabilize the emulsion.

| | |
|---|---|
| Adenine | 15 mg |
| Ammonium thiocyanate | 95 mg |
| Chloroauric acid | 2.5 mg |
| Sodium thiosulfate | 2.0 mg |
| Triphenylphosphine selenide | 280 mg |

The solid particle dispersion of the spectral sensitizing dyes was prepared in accordance with a method described in JJP-A 5-297496. Thus, a given amount of the sensitizing dye was added to water maintained at 27° C. and the mixture was stirred with a high-speed stirrer (Dissolver) at 3,500 rpm over a period of 30 to 120 min. to obtain the dispersion.

The dispersion of triphenylphosphine selenide above-described was prepared in the following manner.

Triphenylphosphine selenide of 120 g was dissolved in 3.0 kg of ethyl acetate kept at 50° C. with stirring and 93 g of an aqueous 25% solution of sodium dodecylbenzenesulfonate was added thereto. The mixture was dispersed, at 50° C., using a high-speed stirring type dispersing machine having a dissolver with a diameter of 10 cm at a dispersing cycling speed of 40 m/sec. for 30 min. Thereafter, the dispersion was quickly subjected to stirring under reduced pressure to remove ethyl acetate until a residual concentration ethyl acetate reached 0.3 wt %, and was diluted with water to make 80 kg. A portion of the thus prepared dispersion was employed.

Preparation of coating solution of emulsion layer

To each of the emulsion, the following additives were added and further thereto was added the composite polymer compound of the invention, as shown in Table 2 to prepare a coating solution of the emulsion layer. The addition amount is expressed in per mol of silver halide.

| | |
|---|---|
| 1,1-Dimethylol-1-bromo-nitromethane | 70 mg |
| Tert.-butylcatechol | 400 mg |
| 2,6-bis-(hydroxyamino)-4-diethylamino-1,3,5-triazine | 0.15 mg |
| Polyvinyl pyrrolidone (M.W. 10,000) | 1.0 g |
| Stylene-maleic acid copolymer | 2.5 g |
| Nitrophenyl-triphenylphosphonium chloride | 50 mg |
| ammonium 1,3-dihydroxybenzene-4-sulfonate | 2 g |
| $C_4H_9OCH_2CH(OH)CH_2N(CH_2COOH)_2$ | 1 G |
| 1-Phenyl-5-mercaptotetrazole | 15 mg |
| 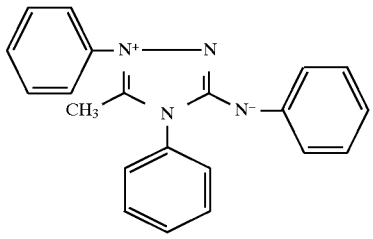 | 150 mg |
| 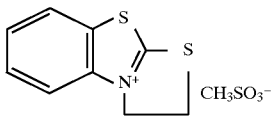 | 70 mg |

Preparation of coating solution of protective layer

The following additives were added and further thereto was added the composite polymer compound of the invention, as shown in Table 2 to prepare a coating solution of the protective layer. The addition amount is expressed in per liter of the coating solution.

| | |
|---|---|
| Lime-processed inert gelatin | 68 g |
| Acid-processed gelatin | 2 g |
| Sodium i-amyl-n-decylsulfosuccinate | 1 g |
| Polymethylmethacrylate (are-averaged particle size: 3.5 μm, matting agent) | 1.1 g |
| Colloidal silica (av. size: 1.2 mm) | 0.5 g |
| $(CH_2{=}CHSO_2CH_2)_2O$ | 500 mg |
| $C_4F_9SO_3K$ | 2 mg |
| $C_{12}H_{25}CONH(CH_2CH_2O)_5H$ | 2.0 g |
| 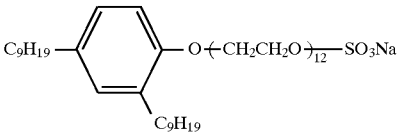 | 1.0 g |
| 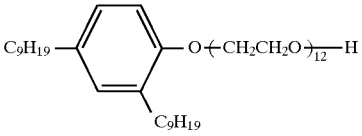 | 0.4 g |
| 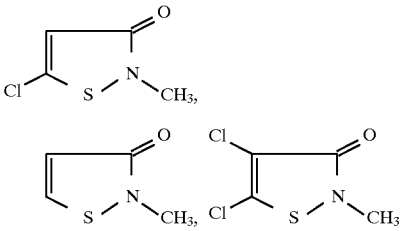 (50:46:4) | 0.1 g |

Preparation of cross-over-cut layer

On both sides of blue-tined polyethylene terephthalate support with a thickness of 175 μm, were coated cross-over-cut layers having the following composition to prepare a support sample. The addition amount is expressed in an amount per $m^2$ of a photographic material.

| | |
|---|---|
| Dye 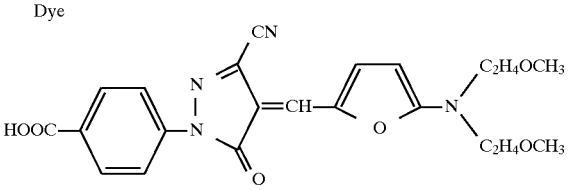 | |
| Gelatin | 0.2 g |
| p-Nonylphenol-polyethyleneoxide (polymerization degree: 10) | 0.006 g |
| Anhydro-1-(morpholino-N-carbonyl)-4-(2-sulfoethyl)pyridinium hydroxide | 0.08 g |
| polymethyl methacrylate (av. particle size: 2.5 μm) | 0.002 g |

Coating

Using these coating solutions, the following layers were coated on both sides of the support by simultaneous double sided coating at a speed of 120 m/min. so as to have a silver coverage of 1.6 g/$m^2$ and dried for 2 min. 20 sec.

TABLE 2

| Layer | Gelatin amount (g/$m^2$)* |
|---|---|
| Upper layer (Protective layer) | 0.8 |
| Interlayer (Emulsion layer) | 1.5 |
| lower layer (filter layer) | 0.2 |

*: Amount per one side

Evaluation of samples (1) Reproducibility of sensitivity

Thus prepared photographic material samples each were laminated with two sheets of fluorescent screens (KO-250, product by Konica) and exposed, through an aluminum wedge, to X-ray (bulb voltage of 80 kvp, bulb current of 100 mA) for 0.05 sec. Exposed samples were processed using an automatic processor (SRX-503, product by Konica). Compositions of a developer and fixed are as follows.

| Developer (for 12 liter) | |
|---|---|
| Part A | |
| Potassium hydroxide | 450 g |
| Potassium sulfite (50% aq. solution) | 2280 g |
| Diethylenetriamine pentaacetic acid | 120 g |
| Sodium hydrogencarbonate | 132 g |
| Boric acid | 40 g |
| 5-Methylbenztriazole | 1.4 g |
| 5-Nitrobenzimidazole | 0.4 g |
| 1-Phenyl-5-mercaptotetrazole | 250 g |
| 4-hydroxymethyl-4-methy-1-phenyl-3-pyrazolidone | 120 g |
| Hydroquinone | 400 g |
| Water to make | 6000 ml |
| Part B | |
| Glacial acetic acid | 70 g |
| 5-Nitroindazole | 0.6 g |
| N-acetyl-D,L-penicillamine | 1.2 g |
| Starter | |
| Glacial acetic acid | 120 g |
| $HO(CH_2)_2S(CH_2)_2OH$ | 1 g |
| Kbr | 225 g |
| $CH_3N(C_3H_6NHCONHCH_2SC_2H_5)_2$ | 1 g |
| 5-Methylbenztriazole | 1.5 g |
| Water to make | 1 l |
| Fixer (for 18.3 liter) | |
| Part A | |
| ammonium thiosulfate | 4500 g |
| Sodium sulfite anhydride | 450 g |
| Sodium acetate trihydride | 450 g |
| Boric acid | 110 g |
| Tartaric acid | 60 g |
| Sodium citric acid | 10 g |
| Gluconic acid | 70 g |
| 1-(N,N-dimethylamino)-ethyl-5-mercaptotetrazole | 18 g |
| Glacial acetic acid | 330 g |
| Aluminum sulfate | 62 g |
| Water to make | 7200 ml |

To 5 l of water were simultaneously added part A and B with stirring, and water was further added thereto to make 12 l of the developer. The pH was adjusted to 10.53. This solution was employed as a replenisher.

To 1 l of the replenisher was added 20 ml of the starter and the pH was adjusted to 10.53 to make a working solution.

To 5 l of water was added part A of the fixer with stirring and water was further added thereto to make 18.3 l, and the pH was adjusted to 4.6 to make a fixer replenisher.

Processing temperatures in developing, fixing, washing and drying were respectively 35°, 33°, 20° and 50° C. Processing time (dry to dry time) was 25 sec. Replenishing rate of the developer and fixer were respectively 65 ml per $m^2$ of a photographic material.

The sensitivity was expressed as reciprocal of exposure that gave a density of 1.0. The sensitivity was shown as an average of 50 observed values with respect to the sensitivity of each sample, and denoted as a relative value, based on that of Sample No.1 being 100. The relative sensitivity of each sample was within a range of 100 to 100.8. A standard deviation of observed values of the sensitivity of each sample was determined to evaluate the reproducibility of the sensitivity. The smaller its value is, the smaller the fluctuation in the sensitivity is.

(2) Evaluation with respect to luster of silver image

Each sample was subjected to X-ray exposure, in a manner similar to (1), that gave a density of 1.2±0.5 and processed in the same manner as in (1). Samples were visually evaluated based on the following criteria.

A: Slightly lustered but no problem.

B: Lustered but visually acceptable level

C: Remarkably lustered and visually unacceptable level

TABLE 3

| | Emulsion | | Composite material | | | Fluctuation | Luster of | |
|---|---|---|---|---|---|---|---|---|
| Sample No. | Em-No. | Desal-ting | Mate-rial | Layer | Amount ($mg/m^2$) | in sensitivity | silver image | Re-marks |
| 1 | Em-1 | Coag.* | — | — | — | 5.2 | A | Comp. |
| 2 | Em-1 | Coag. | PL-5 | Pro*** | 500 | 4.92 | B | Comp. |
| 3 | Em-1 | Coag. | PL-5 | Pro/Em | 500/200 | 4.98 | B | Comp. |
| 4 | Em-1 | Coag. | PL-7 | Pro | 500 | 5.43 | A | Comp. |
| 5 | Em-1 | Coag. | PL-7 | Em | 500 | 5.17 | A | Comp. |
| 6 | Em-1 | Coag. | PL-7 | Pro/Em | 200/500 | 4.96 | A | Comp. |
| 7 | Em-2 | Uf.** | — | — | — | 0.82 | C | Comp. |
| 8 | Em-2 | Uf. | PL-5 | Pro | 500 | 0.78 | A | Inv. |
| 9 | Em-2 | Uf. | PL-5 | Pro/Em | 500/200 | 0.75 | A | Inv. |
| 10 | Em-2 | Uf. | PL-7 | Pro | 500 | 0.77 | A | Inv. |
| 11 | Em-2 | Uf. | PL-7 | Em | 500 | 0.84 | A | Inv. |
| 12 | Em-2 | Uf. | PL-7 | Pro/Em | 200/500 | 0.85 | A | Inv. |
| 13 | Em-2 | Uf. | PL-1 | Pro | 500 | 0.72 | A | Inv. |
| 14 | Em-2 | Uf. | PL-1 | Em | 500 | 0.87 | A | Inv. |

*Coagulation
**Ultrafiltration
***Pro: Protective layer Em: Emulsion layer

As can be seen from the Table, according to the invention, there was achieved a silver halide photographic material small in fluctuation of the sensitivity, even when processing was repeated 50 times and having silver images which is slightly lustered and visually acceptable.

What is claimed is:

1. A silver halide photographic light sensitive material comprising a support, having thereon component layers including a light sensitive silver halide emulsion layer and a light insensitive hydrophilic colloid layer, wherein said silver halide emulsion layer comprises a silver halide emulsion which has been subjected to desalting by ultrafiltration, at least one of the component layers containing a composite material comprising inorganic particles and a hydrophobic polymer, said silver halide emulsion comprising silver halide grains having an average grain size of about 0.15 to about 5.0 microns.

2. The silver halide photographic material of claim 1, wherein said hydrophobic polymer comprises a hydrophobic monomer selected from the group consisting of acrylates, methacrylates, vinyl esters, olefines, stylenes, crotonates, itaconic acid diesters, maleic acid diesters, fumaric acid diesters, allyl compound, vinyl ethers, vinyl ketones, vinyl heterocyclic compound, glycidyl esters and unsaturated nitrites.

3. The silver halide photographic material of claim 2, wherein said hydrophobic polymer is selected from the group consisting of acrylates, methacrylates and stylenes.

4. The silver halide photographic material of claim 2, wherein said hydrophobic monomer has a glycidyl group.

5. The silver halide photographic material of claim 1, wherein said composite material further comprises a water-soluble polymer.

6. The silver halide photographic material of claim 1, wherein said composite material is in the form of particles having an average size of 0.005 to 3.0 $\mu$m.

7. The silver halide photographic material of claim 1 wherein said inorganic particles are composed of an oxide of a metal selected from the group consisting of Na, K, Ca, Ba, Al, Zn, Fe, Cu, Ti, Sn, In, W, Y, Sb, Mn, Ga, V, Nb, Tm, Ag, Bi, B, Si, Mo, Ce, Cd, Mg and Be.

8. The silver halide photographic material of claim 2, wherein said metal oxide is selected from the group consisting of $SiO_2$, $TiO_2$, $ZnO_2$, $SnO_2$, MgO, $MnO_2$, $Fe_2O_3$, $ZnSiO_{l,Al2}O_3$, $BeSiO_4$, $Al_2SiO_5$, $ZrSiO_5$, $CaWO_4$, $CaSiO_3$, $InO_2$, $SnSbO_2$, $Sb_2O_5$, $Nb_2O_5$, $Y_2O_3$, $CeO_2$, $Sb_2O_3$, $Na_2O$, $V_2O_5$ and $B_2O_3$ .

9. The silver halide photographic material of claim 7, wherein said metal oxide particles have an average particle size of 3 to 1000 nm.

10. The silver halide photographic material of claim 7, wherein said metal oxide particles are contained, in said composite material, in amount of 30 to 1000% by weight of said hydrophobic polymer.

11. The silver halide photographic material of claim 1, wherein said composite material is contained in an amount of 5 to 300% of a binder contained in said at least one of said component layers.

12. A silver halide photographic light sensitive material comprising a support having thereon component layers including a light sensitive silver halide emulsion layer and a light insensitive hydrophilic colloid layer, wherein at least one of the component layers comprises a composite material comprising inorganic particles and a hydrophobic polymer; said silver halide emulsion layer comprises a silver halide emulsion, which is prepared by a process comprising (i)

incorporating, in a medium, an aqueous silver salt and a halide salt, or silver halide fine grains to form a silver halide emulsion and (ii) subjecting the emulsion formed to desalting by ultrafiltration to remove soluble salts, wherein said silver halide emulsion comprises silver halide grains having an average grain size of about 0.15 to about 5.0 microns.

13. The silver halide photographic light-sensitive material of claim 12 wherein said medium is gelatin.

* * * * *